US006725899B2

(12) United States Patent
Jo

(10) Patent No.: US 6,725,899 B2
(45) Date of Patent: Apr. 27, 2004

(54) APPARATUS FOR AND METHOD OF RECLAIMING MOLDING SAND

(75) Inventor: Jeon Rae Jo, Pusan (KR)

(73) Assignee: Kiwon Metal Co., Ltd., Gimhae (KR)

( * ) Notice: Subject to any disclaimer, the term of this patent is extended or adjusted under 35 U.S.C. 154(b) by 0 days.

(21) Appl. No.: 10/280,007

(22) Filed: Oct. 25, 2002

(65) Prior Publication Data

US 2003/0079851 A1 May 1, 2003

(30) Foreign Application Priority Data

Oct. 25, 2001 (KR) ..... 2001-65961

(51) Int. Cl.[7] ..... B22C 5/00; B02C 19/12

(52) U.S. Cl. ..... 164/5; 164/200; 164/412; 241/67; 241/DIG. 10

(58) Field of Search ..... 164/5, 270.1, 200, 164/412; 241/67, 47, 257, DIG. 10

(56) References Cited

U.S. PATENT DOCUMENTS 4,089,081 A * 5/1978 Jacob ..... 15/93.1
4,436,138 A * 3/1984 Kondo ..... 164/5
5,045,090 A * 9/1991 Pohl ..... 512/6
5,062,470 A * 11/1991 Rikker ..... 164/457
5,515,907 A * 5/1996 Boenisch ..... 164/456
5,706,879 A * 1/1998 Renner et al. ..... 164/5
6,401,798 B1 * 6/2002 Kondo ..... 164/412
6,516,863 B2 * 2/2003 McVane ..... 164/5

* cited by examiner

*Primary Examiner*—M. Alexandra Elve
*Assistant Examiner*—Len Tran
(74) *Attorney, Agent, or Firm*—Jacobson Holman PLLC

(57) ABSTRACT

Disclosed are an apparatus for and a method of reclaiming molding sand capable of increasing a recycling efficiency of used molding sand and of highly enhancing the purity of a reclaimed molding sand. By crushing a lump of molding sand segregated from a molding box, used molding sand can be formed. In order to remove coking agents sticking on a surface of the used molding sand, an impeller disposed in a rotatable grinding drum is rotated after charging the used molding sand into a casing in which the rotatable grinding drum is disposed. The coking agents sticking on the surface of the used molding sand are removed due to collision and a mutual frictional rolling contact between the used molding sand and the rotatable grinding drum with the aid of rotational force of the impeller after having accomplished charging the used molding sand toward the impeller. Fine powders of the coking agents segregated from the used molding sand are exhausted through a dust collecting port together with external air introduced into the casing through an inlet pipe of a rotational shaft disposed in operative association with a motor at the center of the casing.

5 Claims, 2 Drawing Sheets

【FIG 1】
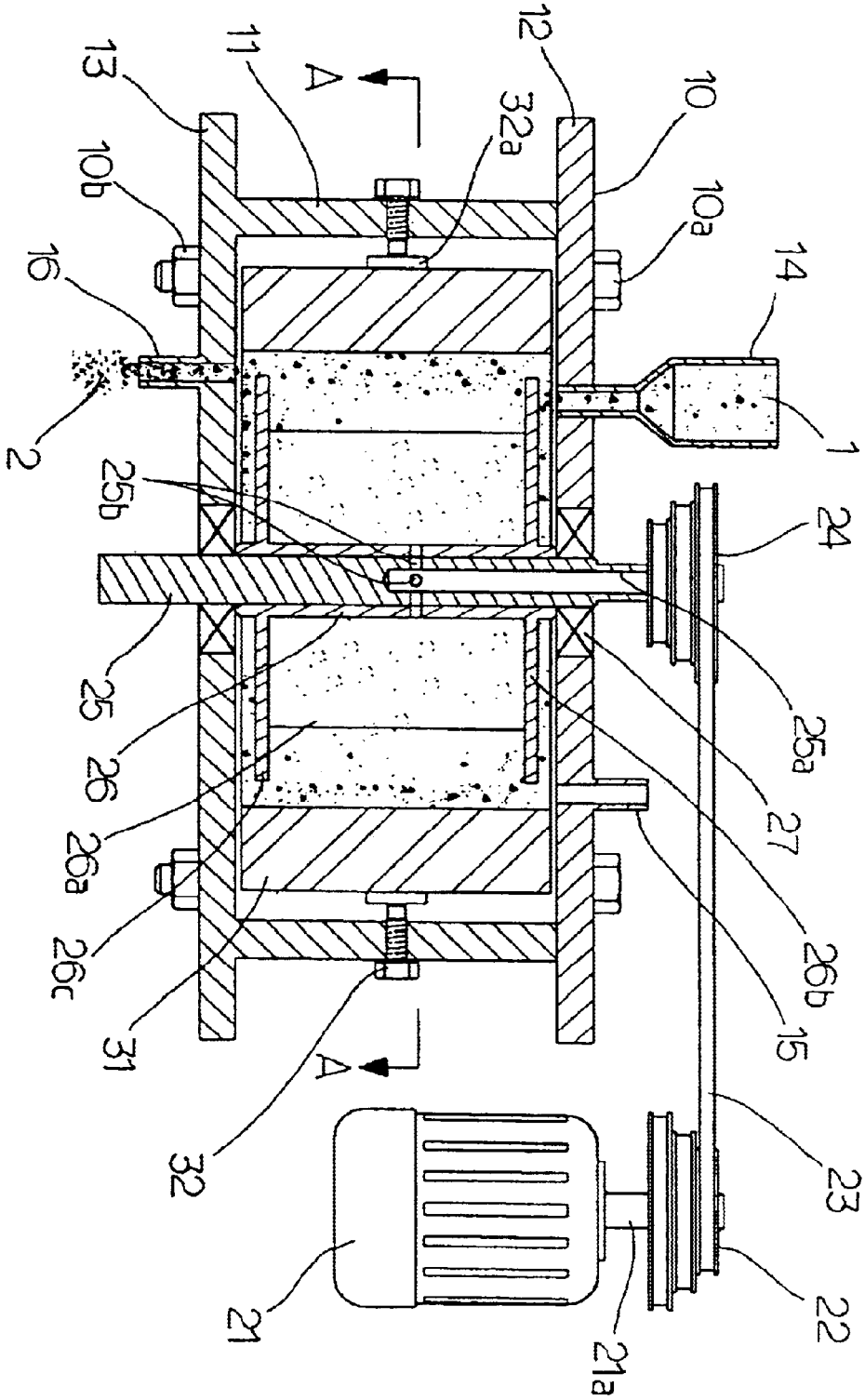

【FIG 2】
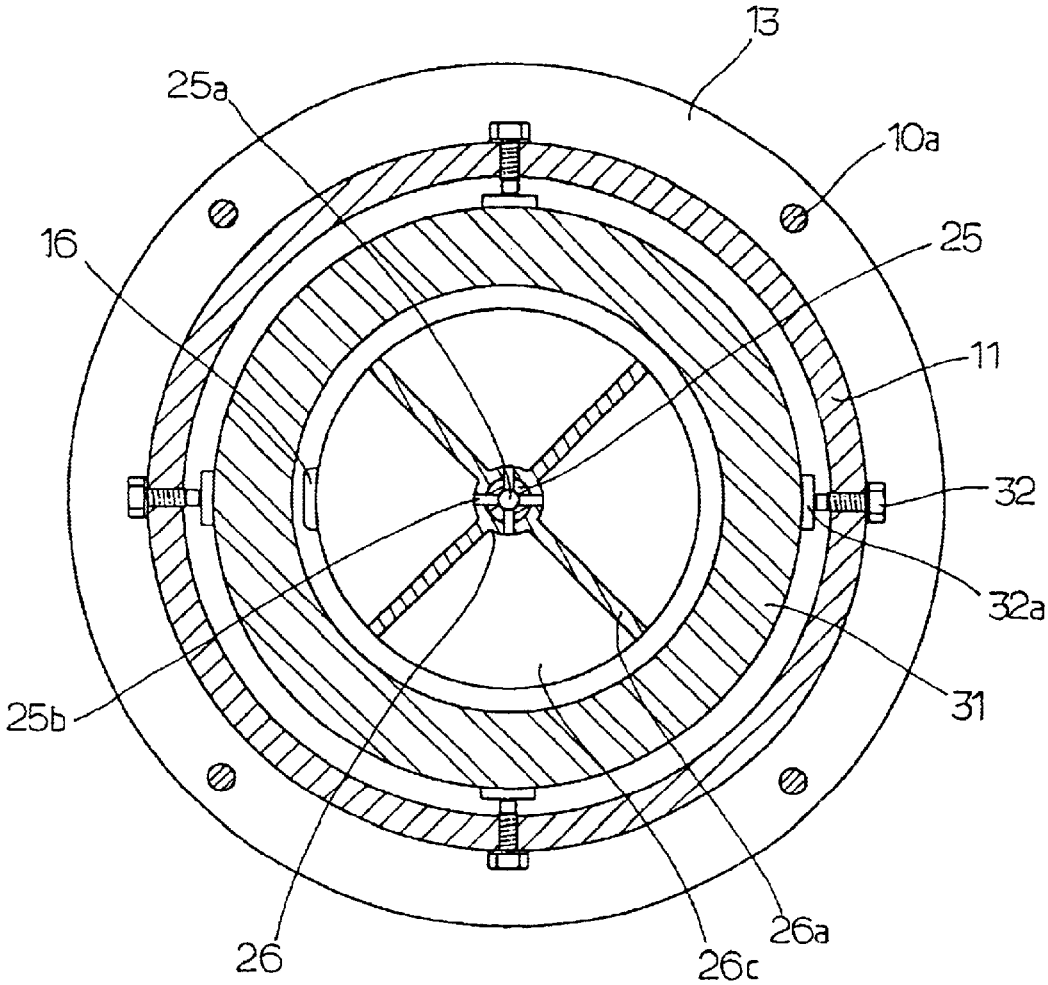

APPARATUS FOR AND METHOD OF RECLAIMING MOLDING SAND

BACKGROUND OF THE INVENTION

1. Field of the Invention

The present invention relates to an apparatus for and a method of reclaiming molding sand, and more particularly to an apparatus for and a method of reclaiming molding sand capable of increasing a recycling efficiency of used molding sand and of highly enhancing the purity of a reclaimed molding sand, which is capable of prevent the reclaimed molding sand from being damaged and of simplifying the total construction of the apparatus for reclaiming molding sand relative to the conventional molding sand recycling apparatus, by removing coking agents sticking on a surface of the used molding sand due to a collision and a mutual frictional rolling contact between the used molding sand and a rotatable grinding drum during rotation of an impeller in a casing after having accomplished charging the used molding sand toward the impeller in the casing, and thereafter by exhausting fine powders of coking agents, which are segregated from the used molding sand, through a dust collecting port together with external air introduced into the casing through an inlet pipe of a rotational shaft.

2. Description of the Prior Art

Casting process, which has been widely used for manufacturing a metal product, includes several steps of forming a molten metal by heating a metal at its melting point, pouring the molten metal into a molding box having a shape that is exactly the same as a desired metal product, cooling and solidifying the molten metal in the molding box.

In the conventional casting process as described above, the molding box used for molding a molten metal into a product is formed by using a molding sand composition, which comprises silica sand having an excellent refractoriness as main component. This molding sand composition combines sand having about 20 to 70 mesh size, about 4 to 8% of clay as a coking agent, and about 2 to 6% of moisture. The molding box is produced by pouring the molding sand composition as described above into a mold, in which a desired pattern is provided therein, and by continuously solidifying it therein.

However, when a cast-iron product is produced from the conventional molding box, the coking agent is sticking on the surface of molding sand due to high temperature of the molten metal. If this used molding sand having the coking agent sticking on the surface thereof is used for next casting of a product without performing any additional process for removing the coking agent, then a mutual combining force between molding sands is weaken and the ventilation between molding sands deteriorates, which always leads to a harm to a cast-iron product. In order to solve these problems, it always needs to remove the coking agent sticking on the surface of the used molding sand and continuously revive new molding sand having a desired purity.

There are many techniques and procedures well known in the art by which used molding sand is recycled. For example, the first type of recycling technique is that used molding sand is sprayed toward a grinding piece at a high speed. This recycling technique provides an excellent processing performance. However, a problem associated with this processing used molding sand into reclaimed molding sand is that the grinding piece is severely partially worn away, which always needs a frequently replacement of the grinding piece, and leads to an increased cost of reclaiming used molding sand. Other problems associated with this recycling technique are that molding sand may be easily brown down owing to a strong collusion against the grinding piece and it is very hard to separate fine powders of coking agents and fine powders of the grinding piece from reclaimed molding sand.

Alternatively, the second type of recycling technique is that used molding sand is processed by mechanically vibrating it in a vibrating device with the aid of air stream. However, one problem associated with this processing used molding sand into reclaimed molding sand is that the total construction of the vibrating device used for performing this technique is very complicated, which always needs much time and brings about an increase in cost of producing recycled molding sand having a desired purity.

Alternatively, the third type of recycling technique is that used molding sand is washed by water. However, one problem associated with this processing used molding sand into reclaimed molding sand is that it is very hard to remove the coking agent sticking on the surface of used molding sand by using only this washing technique, which always needs for installing additional devices such as a vibrating device and brings about an increase in cost of producing a reclaimed molding sand.

In the mean time, when a resin is used as a coking agent for molding sand, the resin is removed from a surface of the molding sand by heating used molding sand at a high temperature. However, in order to heat the used molding sand at a high temperature, it is necessary for installing additional heating devices and brings about an increase in cost of producing a reclaimed molding sand.

The fourth type of recycling technique is that used molding sand is processed by charging it in a rotatable grinding drum, continuously rotating the grinding drum and inducing a mutual frictional rolling contact between used molding sand and the grinding drum. It would be desirable to recycle used molding sand by using this recycling technique.

Conventional apparatus for reclaiming used molding sand having a rotatable grinding drum are disclosed in Korean Patent Publication No. 1981-1841 (Date of Registration: Nov. 17, 1981), Korean Laid-Open Patent Publication No. 1983-7177 (Date of Publication: Oct. 14, 1983) and Korean Laid-Open Utility Model Publication No. 1988-21514 (Date of Publication: Dec. 24, 1988), etc.

However, in these apparatus, coking agents sticking on the surface of the used molding sand may be removed by using a mutual frictional force generated between the grinding drum and the used molding sand during rotation of the grinding drum at a high rotation speed, which leads to special problems. One of the problems is that the operational efficiency relative to removing the coking agents deteriorates, which always needs a lot of time for completely removing the coking gents relative to the second type of recycling technique. Due to this reason, it has not been possible or practical to recycle the used molding sand as reclaimed molding sand having a high purity by only once performing the process of reclaiming used molding sand using the grinding drum.

Other problem associated with these conventional apparatus is that it is very hard to exhaust fine powders segregated from the coking agent through a dust collecting port, which always needs for installing additional devices such as an impeller for easily exhausting the fine powders and brings about an increase in cost of producing a reclaimed molding sand.

Another problem associated with these conventional apparatus is that the total constitution of the apparatus for reclaiming used molding sand becomes complicated and the total volume of the apparatus is very large. In other words, the conventional apparatus are provided with a sand distribution structure for uniformly charging used molding sand into the rotatable drum, a structure for reclaiming the used molding sand into reclaimed molding sand by using the rotatable grinding drum, a structure for exhausting reclaimed molding sand, and a blowing device for supplying external air into the casing, which always needs for spending a large amount of money and a lot of time in order to maintain and repair the apparatus for reclaiming used molding sand, and brings about an increase in cost of manufacturing the apparatus as described above.

SUMMARY OF THE INVENTION

The present invention is contrived to solve the foregoing problems. It is a first object of the present invention to provide an apparatus for reclaiming molding sand capable of increasing a recycling efficiency of used molding sand and of highly enhancing the purity of a reclaimed molding sand, which is capable of prevent the reclaimed molding sand from being damaged and of simplifying the total construction of the apparatus for reclaiming molding sand relative to the conventional molding sand recycling apparatus.

Also, it is a second object of the present invention to provide a method of reclaiming molding sand capable of increasing a recycling efficiency of used molding sand and of highly enhancing the purity of a reclaimed molding sand.

In order to achieve the first object, the present invention provides an apparatus for reclaiming molding sand having a casing constituted of a disc-shaped upper frame, a cylindrical middle frame and a disc-shaped lower frame, which are integrally formed together, in which a hopper for throwing used molding sand in the casing is installed at the upper frame of the casing, a dust collecting port for collecting and exhausting fine powers of coking agents segregated from used molding sand is installed at the upper frame, a reclaimed molding sand extrusion port for extruding reclaimed molding sand from the casing is installed at the lower frame of the casing, a rotational shaft is disposed in operative association with a motor at the center of the casing with vertically passing through the upper frame and the lower frame, characterized in that:

an impeller including pluralities of blades is disposed on the rotational shaft, the blades being formed at an outer peripheral surface of the rotational shaft and extending radially outwards at a predetermined length, in which an upper disc and a lower disc are formed at an upper end and a lower end of the blade, respectively, a tuyere is formed through the center portion of the impeller between the blades of the impeller and is fluid-communicated with an inlet pipe extending from the outside of the casing into the casing along the rotational shaft, a cylindrical grinding drum made of a grinding stone is disposed between the impeller and the middle frame of the casing, the grinding drum being spaced from radial free ends of the upper discs and the lower discs and being spaced from the middle frame at a predetermined distance.

Also, in order to achieve the second object, the present invention provides a method of reclaiming molding sand, of the type wherein a used molding sand is formed by crushing a lump of molding sand segregated from a molding box and is consequently reclaimed by removing coking agents sticking on a surface of the used molding sand, the improvement comprising:

rotating an impeller disposed in a rotatable grinding drum made of a cylindrical grinding stone, the impeller being spaced from the rotatable grinding drum at a predetermined distance;

removing the coking agents from the surface of the used molding sand due to collision and a mutual frictional rolling contact between the used molding sand and the rotatable grinding drum with the aid of rotational force of the impeller after having accomplished charging the used molding sand toward the impeller; and exhausting fine powders of the coking agents, which are segregated from the used molding sand, through a dust collecting port together with external air introduced into the casing through an inlet pipe of a rotational shaft disposed in operative association with a motor at the center of the casing.

As described above, in the apparatus for and the method of reclaiming molding sand according to the preferred embodiment of the present invention, it is possible to process used molding sand into reclaimed molding sand with only once performing the sand reclaiming process. Furthermore, it is possible to prevent the rotatable grinding drum from being worn and to prevent the molding sand from being damaged relative to the conventional apparatus for and the conventional method of reclaiming molding sand using the molding sand recycling technique that the used molding sand is directly sprayed to a grinding piece with the aid of compressed air.

BRIEF DESCRIPTION OF THE DRAWINGS

The above objects and other characteristics and advantages of the present invention will become more apparent by describing in detail a preferred embodiment thereof with reference to the attached drawings, in which:

FIG. 1 is a side elevational view, partly in cross section, of an apparatus for reclaiming molding sand according to the preferred embodiment of the present invention, showing the total structure of the apparatus; and FIG. 2 is a sectional view taken along line A—A of FIG. 1.

DETAILED DESCRIPTION OF THE INVENTION

Hereinafter, the apparatus for reclaiming molding sand according to the preferred embodiment of the present invention will be explained in more detail with reference to the accompanying drawings.

In FIGS. 1 and 2, reference numeral 10*a* denotes a bolt and reference numeral 10*b* denotes a nut for assembling a casing. Furthermore, reference numeral 32*a* denotes a reinforcing piece of a rotatable grinding drum.

As shown in FIGS. 1 and 2, an apparatus for reclaiming molding sand includes a casing 10 constituted of a disc-shaped upper frame 12, a cylindrical middle frame 11 and a disc-shaped lower frame 13, which are integrally formed together.

A hopper 14 for throwing used molding sand 1 in the casing is installed at the upper frame 12 of the casing 10. Furthermore, a dust collecting port 15 for collecting and exhausting fine powders of coking agents segregated from the used molding sand 1 is installed at the upper frame 12. The dust collecting port 15 is communicated with dust collecting device (not shown) such as a cyclone dust collector. A reclaimed molding sand extrusion port 16 for extruding reclaimed molding sand 2 is installed at the lower frame 13 of the casing 10. The reclaimed molding sand extrusion port 16 is communicated with a collecting device (not shown) such as a storage tank (not shown) or a separate collection tank (not shown) for reclaimed molding sand 2.

A rotational shaft 25 is installed at the center of the casing 10 with passing through the upper frame 12 and the lower frame 13. This rotational shaft 25 can smoothly rotate by means of bearings 27 disposed around thereof. A driven pulley 24 is installed at an upper end of the rotational shaft 25. This driven pulley 24 is mechanically connected with a driving pulley 22 of a motor 21 through a belt 23 extending there between. When the motor 21 begins to be operated, the rotational shaft 25 rotates by receiving a rotational driving power transmitted from the motor 21. Preferably, the driving pulley 22 and the driven pulley 24 comprise a predetermined variable pulley so that they can be controlled in accordance with a rotation speed of the rotational shaft 25.

In the meantime, an impeller 26 is disposed on the rotational shaft 25. This impeller 26 includes four to eight blades 26*a* that are formed at an outer periphery surface of the rotational shaft 25 and extend radially outwards at a predetermined length. An upper disc 26*b* and a lower disc 26*c* are formed at an upper end and a lower end of the blade 26*a*, respectively. The upper disc 26*b* and the lower disc 26*c* extend radially outwards from the outer periphery surface of the rotational shaft 25 at a predetermined length greater than the length of the blade 26*a*. When the rotational shaft 25 is rotated due to operation of the motor 21, the impeller 26 can rotate within the casing 10.

The upper disc 26*b* has a function of spraying or pouring used molding sand 1 charged into the casing 10 to the outside at a radial direction. The lower disc 26*c* is spaced from the lower frame 13 and a free end thereof is close to the reclaimed molding sand extrusion port 16. The lower disc 26*c* has a function of guiding the reclaimed molding sand 2 toward the reclaimed molding sand extrusion port 16. A tuyere 25*b* is formed through the center portion of the impeller 26 between the blades 26*a* of the impeller 26. The tuyere 25*b* is fluid-communicated with an inlet pipe 25*a* extending from the outside of the casing 10 into the casing 10 along the rotational shaft 25. When the impeller 26 is rotated, air can be introduced from the outside through the inlet pipe 25*a* of the rotational shaft 25 into the casing 10 via the tuyere 25*b*.

In the meantime, a cylindrical grinding drum 31 made of a grinding stone is disposed between the impeller 26 and the middle frame 11 of the casing 10. At this time, the rotatable grinding drum 31 is spaced from the radial free end of the upper and the lower discs 26*b*, 26*c*. Furthermore, the rotatable grinding drum 31 is spaced from the middle frame 11 at a predetermined distance. The rotatable grinding drum 31 is fixedly installed in the casing 10 by means of a fixture 32 passing through the middle frame 11 and pressing against the rotatable grinding drum 31 in the lateral direction. Preferably, the fixture 32 comprises a fixing member such as a bolt, which passes through the middle frame 11, and presses against an outer surface of the rotatable grinding drum 31. In order to prevent the rotatable grinding drum 31 being damaged, a reinforcing piece 32*a* is disposed between the distal end of the fixture 32 and the outer surface of the rotatable grinding drum 31.

In order to minimize the wear of the used molding sand 1 due to collision between the rotatable grinding drum 31 and the used molding sand 1, the rotatable grinding drum 31 comprises a material selected from the group consisting of aluminum oxide ($Al_2O_3$), silundum (SiC), zirconia ($ZrO_2$) and boron nitride (BN).

Hereinafter, the method of reclaiming molding sand according to the embodiment of the present invention will be described in detail with reference drawings FIGS. 1 and 2. According to the embodiment of the present invention, the reclaiming of used molding sand 1 is proceed by using the apparatus for reclaiming molding sand as described above.

As shown by way of example in FIGS. 1 and 2, when an electric current is applied to the motor 21 of the apparatus for reclaiming molding sand, then the motor 21 begins to be operated. At this time, the rotational shaft 25 disposed in operative association with the motor 21 begins to be rotated. And continuously the impeller 26 is rotated within the rotatable grinding drum 31 at a high rotation speed.

Under this state, the used molding sand 1 is charged into the casing 1 through the hopper 14 installed at the upper frame 12 of the casing 1. The used molding sand 1 may be obtained by crushing a lump of molding sand segregated from a molding box.

When the used molding sand 1 is charged into the casing 1 through the hopper 14, it is dropping onto the upper surface of the upper disc 26*b* of the impeller 26 during rotation of the impeller 26 at a high rotation speed. At this time, the used molding sand 1 is sprayed from the dropping point on the upper disc 26*b* toward an inner peripheral wall of the rotatable grinding drum 31 due to centrifugal force applying to the upper disc 26*b* as a result of the impeller 26's rotation.

The used molding sand 1 sprayed toward the inner peripheral wall of the rotatable grinding drum 31 via the upper disc 26*b* collides with the rotatable grinding drum 31 and thereby a part of coking agents attached to the used molding sand 1 is segregated from the rotatable grinding drum 31 during collision of the used molding sand 1 against the rotatable grinding drum 31. Consequently, the primary process of reclaiming molding sand by using the rotatable grinding drum 31 has been completed.

After having accomplished the collision of the used molding sand 1 against the rotatable grinding drum 31, the used molding sand 1 is subjected to the effects of gravity due to its weight in a direction toward the lower frame 13 of the casing 10. Continuously the used molding sand 1 is also subjected to the effects of the centrifugal force due to a strong rotational blowing generated from the impeller 26, which is applied to the inner peripheral surface of the rotatable grinding drum 31. As a result, the used molding sand 1 cannot directly fall toward the lower frame 13 of the casing 10 and then it slowly descends toward the lower frame 13 with rotating along the inner peripheral surface of the rotatable grinding drum 31 at a spiral trace.

While the used molding sand 1 slowly descends toward the lower frame 13 with rotating along the inner peripheral surface of the rotatable grinding drum 31 at a spiral trace, it rolls and continuously rotates along the inner peripheral surface of the rotatable grinding drum 31. At this time, a mutual rolling frictional contact is accomplished between the used molding sand 1 and the rotatable grinding drum 31 and thereby the secondly process of reclaiming molding sand by using the rotatable grinding drum 31 has been completed. Consequently, the remaining coking agents sticking on the used molding sand 1 are completely removed and the surface of the reclaimed molding sand 2.

In addition, air in the casing 10 is exhausted from the outside through the dust collecting port 15 and the reclaimed molding sand extrusion port 16 during rotation of the impeller 26 at a high rotation speed. Continuously air out of the casing 10 is introduced into the casing 10 through the inlet pipe 25*a* formed at the rotational shaft 25 and then it is exhausted through the tuyere 25*b* formed between the blades 26*a* of the impeller 26. As a result, the used molding sand 1 can be closely contacted with the inner peripheral surface of the rotatable grinding drum 31 with effect. Also, the mutual frictional rolling contact between the used molding sand 1 and the rotatable grinding drum 31 is more successfully performed.

The reclaimed molding sand 2 processed due to collision and mutual frictional rolling contact between the used molding sand 1 and the rotatable grinding drum 31 falls onto the upper surface of the lower frame 13 of the casing 10. While the reclaimed molding sand 2 descends toward the lower frame 13 of the casing 10, it is guided toward the reclaimed molding sand extrusion port 16 by the rotational blowing force of the impeller 26 and the air exhausted through the lower disc 26*c* and the tuyere 25*b* of the impeller 26. Accordingly, the reclaimed molding sand 2 can be re-used as a new molding sand after having accomplished introducing it into a storage tank (not shown) or a separate collect tank (not shown) for the reclaimed molding sand 2.

Fine powders of the coking agents segregated from the surface of the used molding sand 1 during performing the process of reclaiming molding sand has a very light weight. Accordingly, they can be smoothly guided toward the dust collecting port 15 together with external air exhausted through the tuyere 25*b* and then they are exhausted from the casing 10 to the outside. These fine powders of the coking agents are collected at a dust collecting device (not shown) disposed in fluid-communicated with the dust collecting port 15 and then they are thrown away.

As described above, in the apparatus for and the method of reclaiming molding sand according to the preferred embodiment of the present invention, the used molding sand is charged into the casing 1 and continuously is dropping onto the upper surface of the upper disc 26*b* of the impeller 26 during rotation of the impeller 26 at a high rotation speed. The used molding sand 1 is primarily reclaimed due to collision between the used molding sand 1 and the rotatable grinding drum 31. Continuously one used molding sand, which is generated during descending of the used molding sand 1 along the inner peripheral surface of the rotatable grinding drum 31 at a spiral trace, and another used molding sand, which is generated during proceeding a mutual frictional rolling contact between the used molding sand 1 and the rotatable grinding drum 31 are secondarily reclaimed. Accordingly, it is possible to process the used molding sand 1 into reclaimed molding sand 2 with only once performing the reclaiming process by using the apparatus for reclaiming molding sand according to the preferred embodiment of the present invention.

Furthermore, since the used molding sand 1 is sprayed from the dropping point on the upper disc 26*b* toward an inner circumference wall of the rotatable grinding drum 31 due to centrifugal force applying to the upper disc 26*b* as a result of the impeller 26's rotation, the rotatable grinding drum 31 is not worn and the molding sand is not damaged relative to the conventional apparatus for reclaiming molding sand using the reclaiming technique, in which the used molding sand 1 is directly sprayed onto a grinding piece with the aid of compressed air.

In addition, it is possible to completely remove the coking agents sticking on the surface of the used molding sand 1 by using the collision and the mutual frictional rolling contact between the used molding sand 1 and the rotatable grinding drum 31 relative to the conventional apparatus for reclaiming molding sand as just described above.

More particularly, since the used molding sand 1 can be closely contacted with the inner peripheral surface of the rotatable grinding drum 31 with the aid of external air being exhausted toward the tuyere 25*b* in accordance with the rotation of the impeller 26, it is possible to enhance the operational efficiency for removing the coking agents due to the mutual frictional rolling contact between the used molding sand 1 and the rotatable grinding drum 31. Also, since the surface of molding sand without having the coking agents thereon is trimmed round, it is possible to remarkably enhance the quality of the reclaimed molding sand.

By only rotating the impeller 26, the used molding sand 1 is uniformly sprayed toward the inner circumference wall of the rotatable grinding drum 31 and then it is reclaimed during collision and mutual frictional rolling contact between the used molding sand 1 and the rotatable grinding drum 31. In addition, the remaining coking agents sticking on the used molding sand 1 are completely removed and continuously collected and thereafter they are exhausted from the casing 10 to the outside by using a collecting device (not shown).

Since the inlet pipe for introducing external air used for exhausting fine powder of the coking agents toward the dust collecting port 15 is formed in the rotational shaft 25 of the impeller 26, the total structure of the apparatus for reclaiming molding sand according to the present invention is very simple. Accordingly, it is possible to reduce the total volume of the apparatus for reclaiming molding sand.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An apparatus for reclaiming molding sand having a casing constituted of a disc-shaped upper frame, a cylindrical middle frame and a disc-shaped lower frame, which are integrally formed together, in which a hopper for throwing used molding sand in the casing is installed at the upper frame of the casing, a dust collecting port for collecting and exhausting fine powders of coking agents segregated from used molding sand is installed at the upper frame, a reclaimed molding sand extrusion port for extruding reclaimed molding sand from the casing is installed at the lower frame of the casing, a rotational shaft is disposed in operative association with a motor at the center of the casing, vertically passing through the upper frame and the lower frame, characterized in that:

an impeller including a plurality of blades is disposed on the rotational shaft, the blades being formed at an outer peripheral surface of the rotational shaft and extending radially outwards at a predetermined length, in which an upper disc and a lower disc are formed at an upper end and a lower end of the blades, respectively, a tuyere is formed through the center portion of the impeller between the blades of the impeller and is fluid communicated with an inlet pipe extending from the outside of the casing into the casing along the rotational shaft, a cylindrical grinding drum made of a grinding stone is disposed between the impeller and the middle frame of the casing, the grinding drum being spaced from radial free ends of the upper discs and the lower discs and being spaced from the middle frame at a predetermined distance.

2. In a method of reclaiming molding sand, of the type wherein a used molding sand is formed by crushing a lump of molding sand segregated from a molding box and is consequently reclaimed by removing coking agents sticking on a surface of the used molding sand, the improvement comprising:

rotating an impeller disposed in a rotatable grinding drum made of a cylindrical grinding stone, the impeller being spaced from the rotatable grinding drum at a predetermined distance, said rotatable grinding drum being installed within a casing;

introducing air into the casing through an inlet pipe of a rotational shaft disposed in operative association with a motor at the center of the casing, said inlet pipe being in fluid communication with a tuyere formed through the center portion of the impeller between the blades thereof;

removing the coking agents from the surface of the used molding sand due to collision and a mutual frictional rolling contact between the used molding sand and the rotatable grinding drum with the aid of rotational force of the impeller after having accomplished charging the used molding sand toward the impeller; and exhausting fine powders of the coking agents, which are segregated from the used molding sand, through a dust collecting port together with the external air that was introduced into the casing through the inlet pipe of the rotational shaft.

3. An apparatus for reclaiming molding sand comprising:

a casing constituted of a disc-shaped upper frame, a cylindrical middle frame and a disc-shaped lower frame, which are integrally formed together;

a dust collecting port for collecting and exhausting fine powders of coking agents segregated from used molding sand installed at the upper frame;

a reclaimed molding sand extrusion port for extruding reclaimed molding sand from the casing installed at the lower frame of the casing;

a rotational shaft disposed in operative association with a motor at the center of the casing and vertically passing through the upper frame and the lower frame; and an impeller including a plurality of blades disposed on the rotational shaft, the blades being formed at an outer peripheral surface of the rotational shaft and extending radially outwards at a predetermined length, in which an upper disc and a lower disc are formed at an upper end and a lower end of the blades, respectively, a tuyere being formed through the center portion of the impeller between the blades of the impeller and in fluid communication with an inlet pipe extending from the outside of the casing into the casing along the rotational shaft.

4. The apparatus as set forth in claim 3, further comprising:

a cylindrical grinding drum made of a grinding stone disposed between the impeller and the middle frame of the casing, the grinding drum being spaced from radial free ends of the upper discs and the lower discs and being spaced from the middle frame at a predetermined distance.

5. The apparatus as set forth in claim 3, further comprising:

a hopper installed at the upper frame of the casing for throwing used molding sand in the casing.

* * * * *